United States Patent [19]

Campbell

[11] Patent Number: 5,033,625

[45] Date of Patent: Jul. 23, 1991

[54] EAR-RING STAND

[76] Inventor: Terry A. Campbell, 1695 Pearson Ave., Pr. George British Columbia, Canada, V2L 4K7

[21] Appl. No.: 533,982

[22] Filed: Jun. 5, 1990

[51] Int. Cl.[5] ..... A47F 7/00

[52] U.S. Cl. ..... 211/13; 206/495; D6/469

[58] Field of Search ..... 211/13; D6/310, 469; 206/495, 566, 6.1

[56] References Cited

U.S. PATENT DOCUMENTS

| | | | |
|---|---|---|---|
| D. 234,563 | 3/1975 | Williams | D6/310 |
| D. 304,532 | 11/1989 | Campbell | D6/469 |
| D. 304,533 | 11/1989 | Campbell | D6/310 X |
| 3,997,050 | 12/1976 | Patterson | 211/13 X |
| 4,767,011 | 8/1988 | Butler | 211/13 |
| 4,848,586 | 7/1989 | Jasik | 206/495 X |
| 4,850,658 | 7/1989 | Sandor | 211/13 X |
| 4,923,069 | 5/1990 | Germain et al. | 206/495 X |

*Primary Examiner*—Robert W. Gibson, Jr.
*Attorney, Agent, or Firm*—Townsend and Townsend

[57] ABSTRACT

An ear-ring stand is formed by a sheet-shaped portion for attachment of ear-rings and a base portion for supporting the sheet-shaped portion in an upstanding position. The sheet-shaped portion has perforations therein for receiving the stems of ear-rings and a backing of resilient sheet material behind the perforations for resiliently and releasibly engaging the ear-ring stems upon insertion of the latter through the perforations.

9 Claims, 4 Drawing Sheets

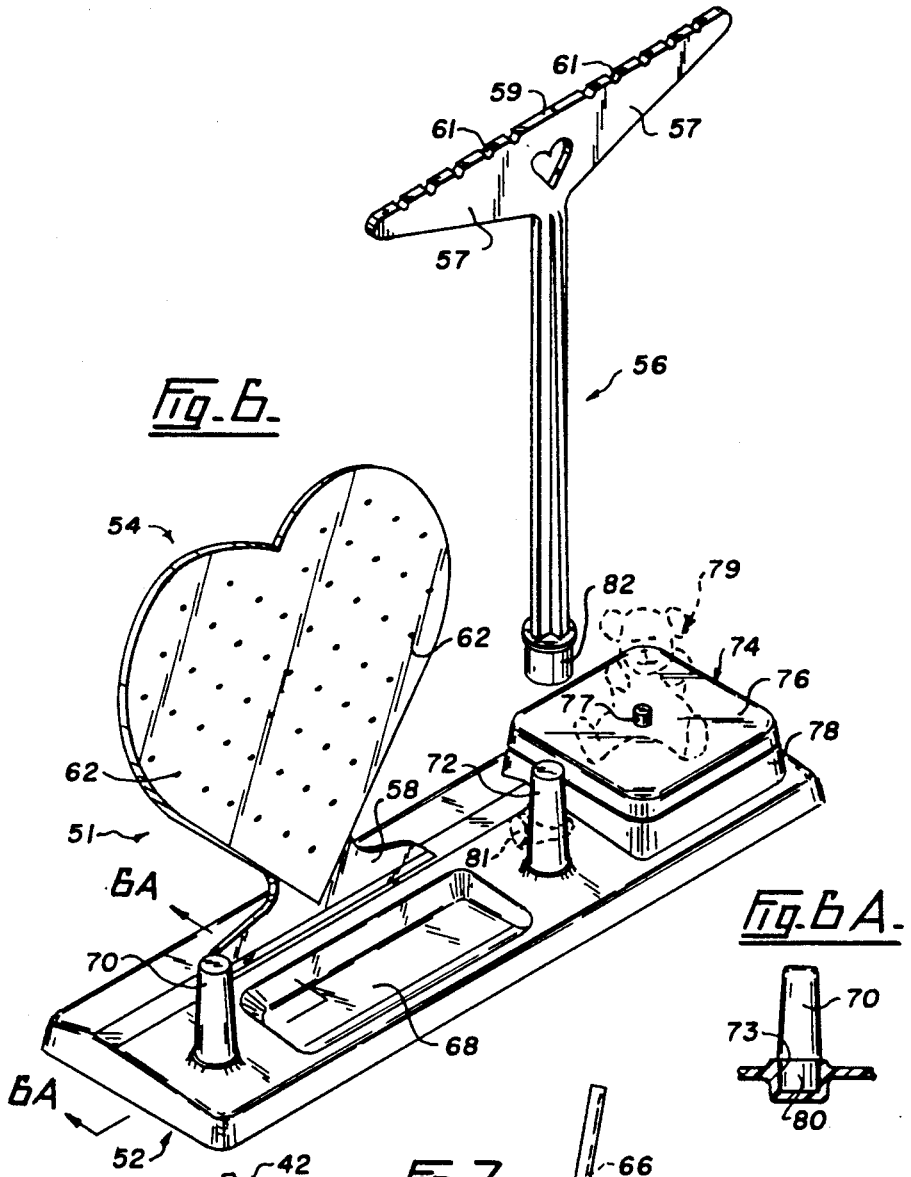
Fig. 6.
Fig. 6A.
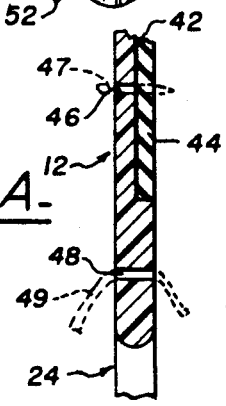
Fig. 5A.
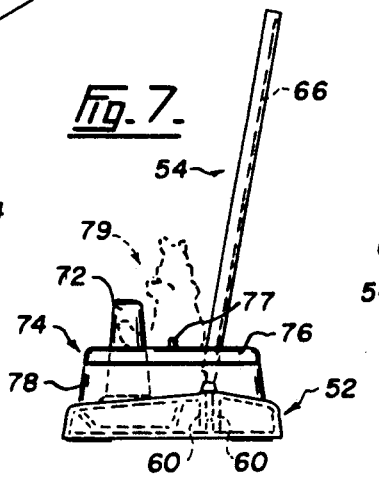
Fig. 7.
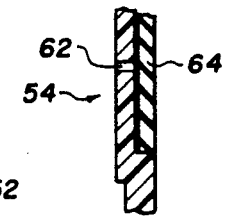
Fig. 10A.

EAR-RING STAND

FIELD OF THE INVENTION

The present invention relates to an ear-ring stand of the type employed for example, on a ladies dressing table for holding a selection of ear-rings for future use.

BACKGROUND OF THE INVENTION

U.S. Pat. Design No. 304,533, issued Nov. 14, 1989 to Terry A. Campbell disclosed an ear-ring stand comprising a sheet-shaped portion, for example a sheet of plastic material, formed with a plurality of perforations extending through the sheet-shaped portion for receiving the stems of ear-rings.

In use, the person using the ear-ring stand stores a selection of ear-rings on the ear-ring stand by inserting the stems of the ear-rings through the perforations. Thus, the ear-rings are held in an orderly manner in positions in which they are readily visible for selection when it is desired to select any of the ear-rings to be worn.

SUMMARY OF THE INVENTION

It is an object of the present invention to provide a novel and improved means for securely retaining ear-rings in a releasible manner relative to an ear-ring stand.

According to the present invention, there is provided an ear-ring stand comprising a sheet-shaped portion for attachment of ear-rings and a base portion for supporting the sheet-shaped portion in an upstanding position. The sheet-shaped portion comprises means defining a plurality of perforations therein for receiving the stems of the ear-rings, and stem engagement means associated with the perforations for resiliently and releasibly engaging the ear-ring stems upon insertion of the latter through the perforations.

In a preferred embodiment of the invention, the stem engagement means comprise a sheet of resilient material, which forms a backing of the sheet-shaped portion of the ear-ring stand.

BRIEF DESCRIPTION OF THE DRAWINGS

Further features, objects and advantages of the invention will appear from time to time from the following description thereof when taken in conjunction with the accompanying drawings, in which:

FIG. 5A shows a broken-away view in cross-section through parts of the ear-ring stand of FIG. 1;

FIG. 6 shows a view in perspective of an ear-ring stand according to a second embodiment of the invention, with parts of the ear-ring stand shown separated from one another;

FIG. 6A shows a broken-away view taken in vertical cross-section along the line 6A—6A of FIG. 6;

FIG. 7 shows a view inside elevation of the ear-ring stand of FIG. 6;

FIG. 10A shows a broken-away view in cross-section through parts of the ear-ring of FIG. 6.

DESCRIPTION OF THE PREFERRED EMBODIMENTS

Figure 1:
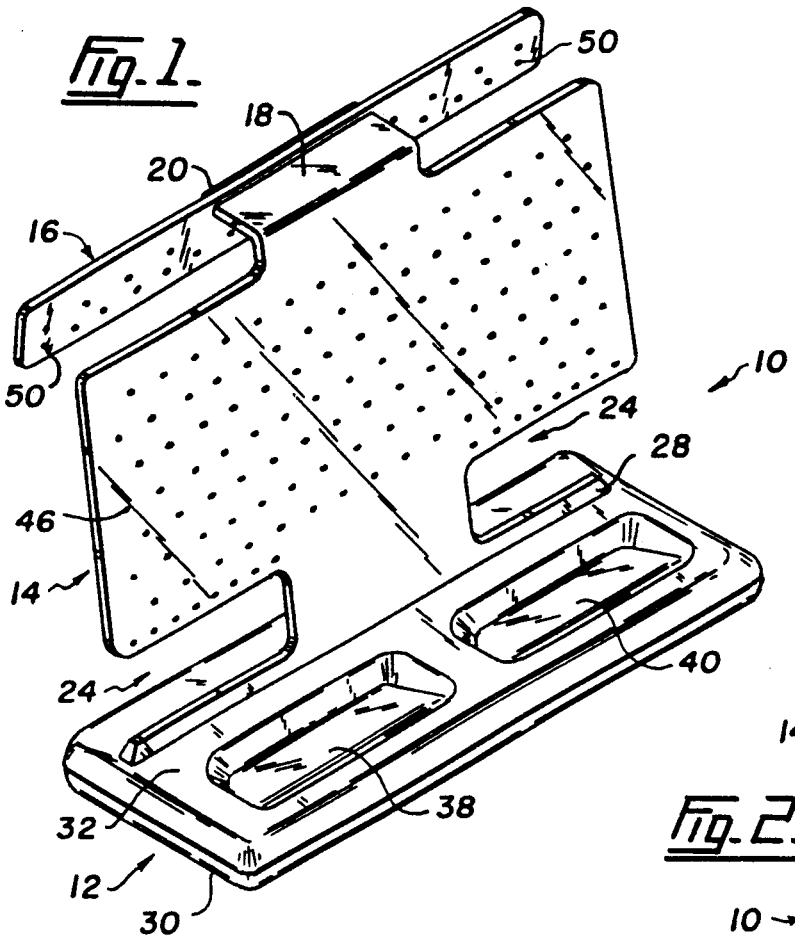
FIG. 1 shows a view in perspective of an ear-ring stand according to a first embodiment of the invention.

Referring now to FIG. 1, reference numeral 10 indicates generally an ear-ring stand according to a first embodiment of the invention, which comprises a base portion indicated generally by reference numeral 12, a sheet-shaped ear-ring support portion indicated generally by reference numeral 14, which is upstanding and rearwardly inclined from the base portion 12, and an elongate ear-ring support portion indicated generally by reference numeral 16, which is spaced rearwardly from the top of the sheet-shaped portion 14, to which it is connected by a bridge portion 18, and which is parallel to the sheet-shaped portion 14.

Figure 2:
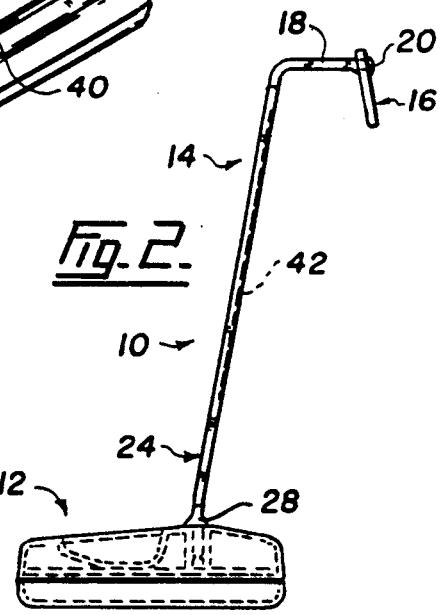
FIG. 2 shows a view in side elevation of the ear-ring stand of FIG. 1.

The bridge portion 18 is formed in one piece with the sheet-shaped portion 14, and has an outer edge portion 20 (FIGS. 2 and 2A), which is engaged in a slot 22 in the elongate portion 16 for connecting the latter to the bridge portion 18 and, thus, to the sheet-shaped portion 14.

The sheet-shaped portion is formed, near the bottom thereof, with a pair of laterally outwardly open, generally rectangularly shaped recesses indicated generally by reference numerals 24, with an elongate lower portion 26 extending beneath the recesses 24.

Figure 2A:
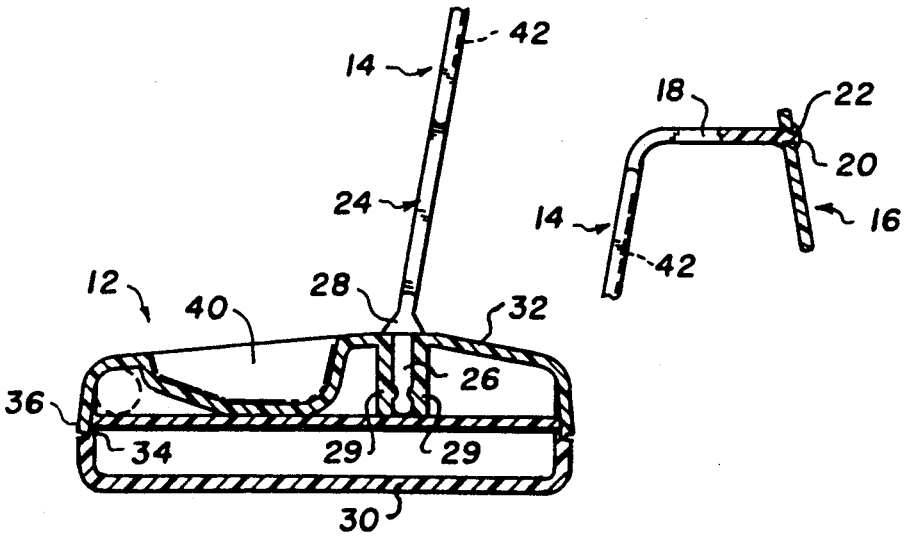
FIG. 2A shows a view corresponding to that of FIG. 2, but with the base and other parts of the stand broken-away in cross section to illustrate the construction thereof.
Figure 3:
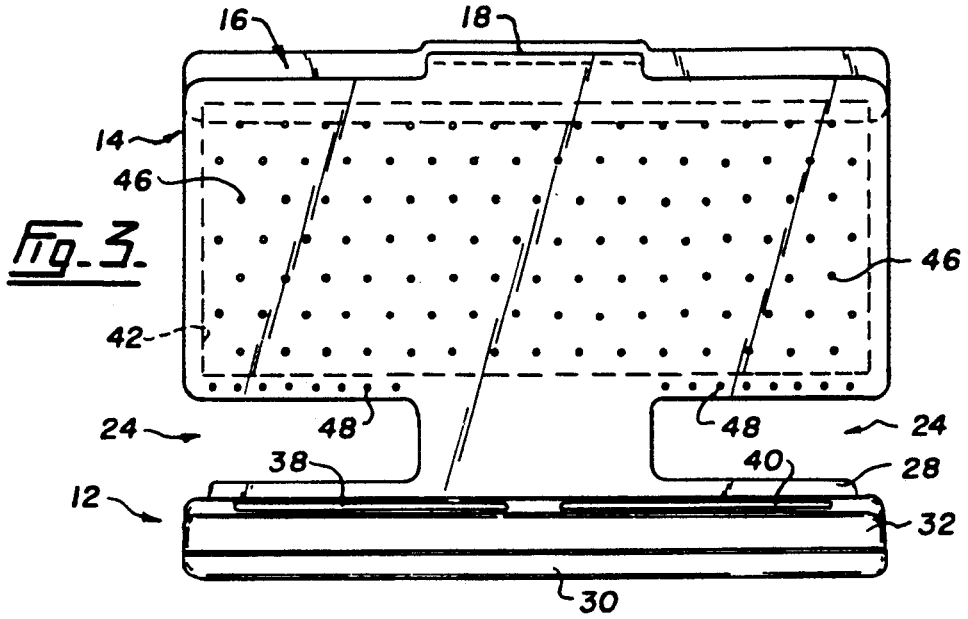
FIG. 3 shows a view in front elevation of the ear-ring stand of FIG. 1.
Figure 4:
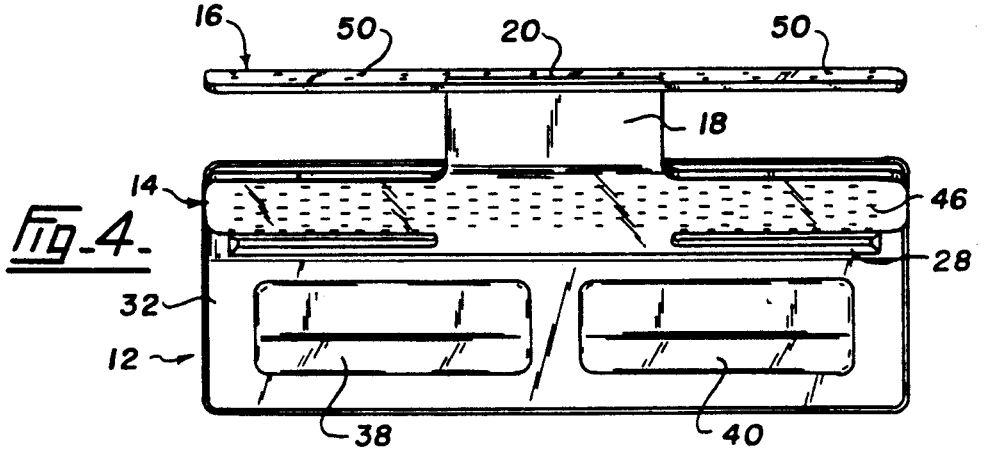
FIG. 4 shows a plan view of the ear-ring stand of FIG. 1.

The lower portion 26, as can be seen in FIG. 2A, is formed with a widened portion or shoulder 28, which abuts the top surface of the base portion 12, and projects downwardly therefrom into snap-action engagement with and between a pair of walls 29 formed as parts of the base portion 12.

The base portion 12 comprises a concave upwardly-open lower portion 30 and a downwardly concave upper portion 32, the portions 30 and 32 having matingly engaged peripheral edges 34 and 36 and defining therein a hollow interior space.

The upper portion 32 is also shaped to define a pair of upwardly-open recesses 38 and 40 which, as can be seen in FIG. 1, are laterally spaced from one another and which are elongate in the lateral direction of the stand. These recesses 38 and 40 serve to receive objects for example-rings, broaches and the like.

The sheet-shaped portion 14 is formed at its rear side with a shallow rectangular recess 42, which extends over the majority of the area of the sheet-shaped portion 14 and which receives therein a sheet 44 of elastomeric material, which is substantially co-extensive with the recess 42 and which is secured to the sheet-shaped portion 14 by means of an adhesive (not shown).

The sheet-shaped portion 14 is formed with horizontal rows of perforations 46 extending through the thickness of the sheet-shaped portion 14 and closed, at the rear side of the sheet-shaped portion 14, by the elastomeric material sheet 44.

When the stand is in use, ear-rings of the type having short, straight stems have their stems inserted through the perforations 46, so that the ear-ring stems penetrate into the elastomeric material sheet 44 and are thereby resiliently gripped and releasibly retained by the elastomeric material sheet 44. One such ear-ring stem is indicated by reference numeral 47 in FIG. 5A.

Figure 5:
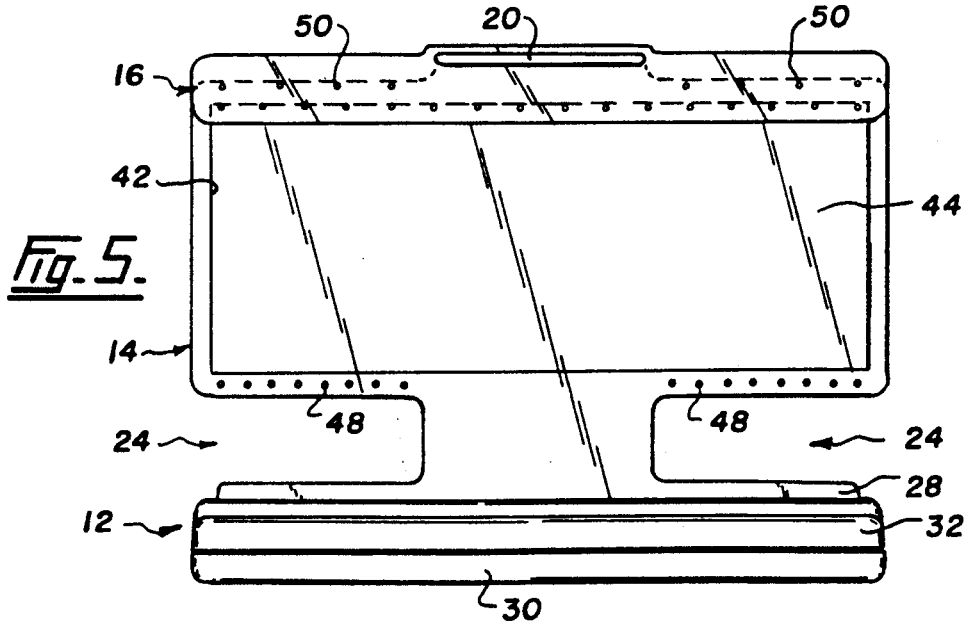
FIG. 5 shows a view in rear elevation of the ear-ring stand of FIG. 1.
Figure 8:
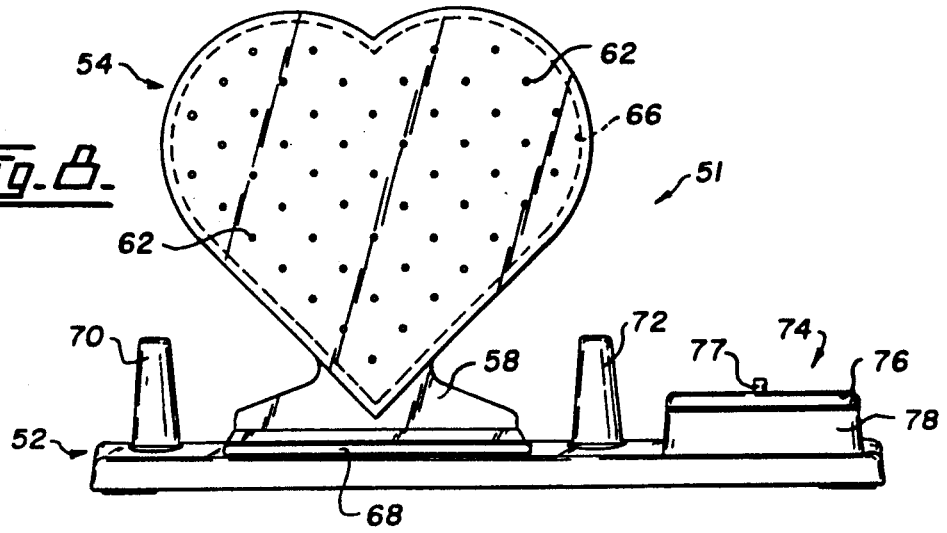
FIG. 8 shows a view in front elevation of the ear-ring stand of FIG. 6.
Figure 9:
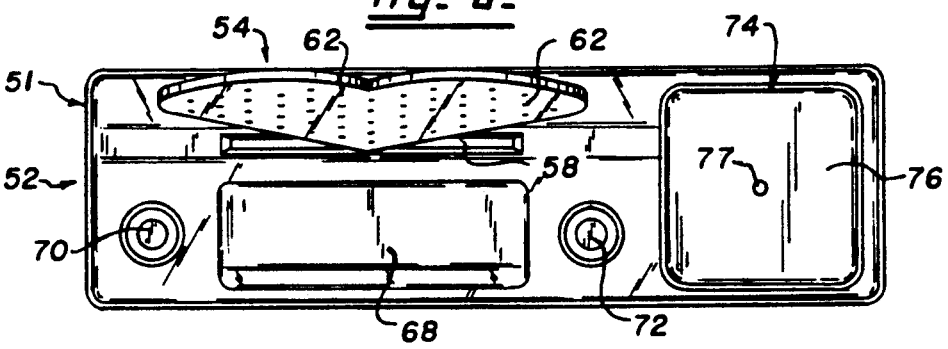
FIG. 9 shows a plan view of the ear-ring stand of FIG. 6.
Figure 10:
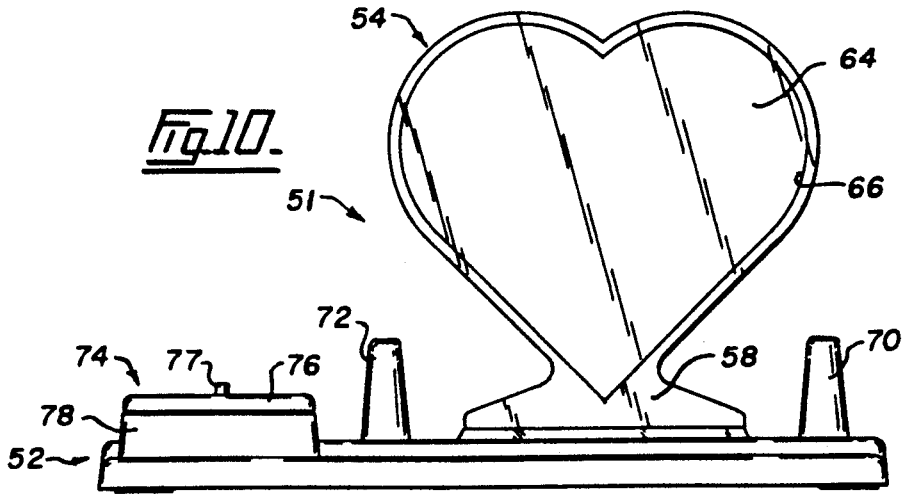
FIG. 10 shows a view in rear elevation of the ear-ring stand of FIG. 6.

The sheet-shaped portion 14 is also formed, above each of the recesses 24, with a row of perforations 48 which, as can be seen from the rear view of FIG. 5, are located below the elastomeric material sheet 44. These perforations 48 serve to receive the stems of ear-rings of the type having long, curved or loop-shaped stems, one of which is indicated by reference numeral 49 in FIG. 5A, which can be inserted through the perforations 48 so as to suspend the ear-rings in the recesses 24.

The elongate portion 16 at the top of the stand is likewise formed with perforations 50, having no resilient material sheet behind them, for receiving similar long, curved or loop-shaped ear-ring stems such as the stem 49. Also, rings can be placed over and supported by the elongate portion 16.

The second embodiment of the invention will now be described with reference to FIGS. 6 through 10.

In FIG. 6, an ear-ring stand is indicated generally by reference numeral 51, and comprises a base indicated generally by reference numeral 52, a sheet-shaped portion indicated generally by reference numeral 54, which is upstanding from and rearwardly and upwardly inclined from the base portion 52, and a post indicated generally by reference numeral 56.

The sheet-shaped portion 54 is shaped, for aesthetic reasons, in the form of a heart and has a lower shoulder-shaped portion 58, which is inserted between and releasibly retained by a pair of walls 60, forming part of the base 52 (see FIG. 7).

The sheet-shaped portion 54 is formed with a plurality of perforations 62 for receiving the stems of ear-rings, the perforations 62 extending through the thickness of the sheet-shaped portion 54 to a backing 64 (see FIG. 10) of elastomeric material sheet, which is fitted into a heart-shaped recess 66 formed in the rear of the sheet-shaped portion 54. The backing 64 serves to resiliently and releasibly engage the ear-ring stems in a manner similar to the elastomeric material sheet 44 of FIGS. 1 through 5.

The base 52, as can be seen in FIG. 6, is formed with an upwardly concave recess 68, a pair of upstanding projections 70 and 72 at opposite ends of the elongate recess 68 and an intregal box or container indicated generally by reference numeral 74, which includes a lid 76 supported on the top of a wall 78 projecting upwardly at the top of the base 52.

The top of the post 56 merges into a pair of arms 57, which project from opposite sides of the post 56 and which have horizontal upper edges 59 formed with transverse recesses 61 for receiving loop-shaped stems of ear-rings, or other appropriate objects such as, for example, rings, bracelets and necklaces.

The lid 76 is formed with an integral post 77 upstanding from the top of the lid 76. The post 77 is engageable in a corresponding opening (not shown) in the underside of a figurine, shown in broken lines and indicated generally by reference numeral 79. The figurine is thus releasibly secured to the lid 76 and may be readily replaced by a different figurine or other decorative object formed with a corresponding opening for receiving the post 77.

The projections 70 and 72 are fitted in mating engagement in respective ones of a pair of similar recesses 73 formed in the top of the base 52, only one of which is shown and is illustrated in FIG. 6A. The projections 70 and 72 each have a lower end 80 shaped to engage in these recesses 73. The projections 70 and 72 are for holding rings, one of which is shown in broken lines in FIG. 6 and indicated by reference numeral 81.

The post 56 has a lower end 82 which is likewise shaped to matingly engage in either of the recesses 73, so that upon removal of one of the projections 70 and 72 from engagement with the base 52, the post 56 can instead be mounted on the base 56.

Whereas the present embodiment of the invention has a heart-shaped portion 59, it should be understood that the portion may be replaced by a correspondingly perforated replacement sheet-shaped portion of a different shape, e.g. of rectangular shape. For this purpose, the shoulder-shaped portion 58 can be slid from between the walls 60 and replaced by a corresponding shoulder-shaped portion in one piece with the replacement sheet-shaped portion.

Other modifications may be made within the scope of the invention as defined by the appended claims.

I claim:

1. An earring stand comprising:

a sheet-shaped portion for attachment of ear-rings; and a base portion for supporting said sheet-shaped portion in an upstanding position;

said sheet-shaped portion comprising means defining a plurality of perforations therein for receiving the stems of ear-rings;

stem engagement means associated with said perforations for resiliently and releasibly engaging the ear-ring stems upon insertion of the latter through said perforations; and an elongate portion spaced rearwardly from said sheetshaped portion for supporting ear-ring loops hung over said elongate portion.

2. An ear-ring stand as claimed in claim 1, wherein said stem engagement means comprise a sheet of resilient material forming a backing of said sheet-shaped portion.

3. An ear-ring stand as claimed in claim 1, wherein said sheet-shaped portion and said base portion are formed with connecting means which are interengagable with one another for securing together said sheet-shaped portion and said base portions.

4. An ear-ring stand as claimed in claim 1, further comprising a bridge portion extending between said sheetshaped portion and said elongate portion and supporting the latter at a spacing from the former.

5. An ear-ring stand as claimed in claim 1, further comprising a post upstanding from said base portion and supporting said elongate portion.

6. An ear-ring stand as claimed in claim 5, wherein said base portion and said post are formed with interengagable connecting means for releasibly connecting said post to said base portion.

7. An ear-ring stand as claimed in claim 1, wherein said base defines an upwardly-open recess for receiving objects.

8. An ear-ring stand as claimed in claim 7, further comprising lid means for closing said recess.

9. An ear-ring stand as claimed in claim 1, wherein said base portion comprises an upwardly concave lower portion at the underside of said base portion and a downwardly concave upper portion mounted on said lower portion and defining therewith a hollow space within said base portion.

* * * * *